US007856912B2

(12) United States Patent
Corcoran et al.

(10) Patent No.: US 7,856,912 B2
(45) Date of Patent: Dec. 28, 2010

(54) MANUALLY OPERATED PORTABLE DIE CUTTING MACHINE

(75) Inventors: Kevin L. Corcoran, Mission Viejo, CA (US); Robert E. Smathers, Anaheim, CA (US)

(73) Assignee: Ellison Educational Equipment, Inc., Lake Forest, CA (US)

( * ) Notice: Subject to any disclaimer, the term of this patent is extended or adjusted under 35 U.S.C. 154(b) by 1300 days.

(21) Appl. No.: 11/220,284

(22) Filed: Sep. 7, 2005

(65) Prior Publication Data

US 2007/0051221 A1 Mar. 8, 2007

(51) Int. Cl.
*B26D 5/10* (2006.01)
*B26D 5/08* (2006.01)

(52) U.S. Cl. ..... 83/633; 83/588; 83/167; 83/564; 403/321

(58) Field of Classification Search ..... 83/588, 83/633, 607, 628, 167, 684, 522.15, 557, 83/618, 564; 15/144.1; D15/128, 123, 136; 16/DIG. 24, DIG. 41; 412/33, 38, 42; 220/762–764; 234/46–48; 101/19; 100/292–293; 403/321, 403/322.4; 292/194, 200, 203, 210, DIG. 11, 292/108, 347, 336.3, DIG. 30, 249–250, 292/102; D8/336, 341; 99/349, 369; D7/300, D7/306, 308, 313, 331, 336, 343
See application file for complete search history.

(56) References Cited

U.S. PATENT DOCUMENTS 1,692,295 A * 11/1928 Gerard ..... 292/242
2,518,076 A * 8/1950 Scherig ..... 83/397
2,720,157 A * 10/1955 Harrison ..... 99/340
3,073,199 A * 1/1963 Yerkes ..... 83/549
3,379,139 A * 4/1968 Lipinsky ..... 99/450.6
4,035,955 A * 7/1977 Burnett ..... 49/280
4,346,634 A * 8/1982 Jones ..... 83/431
4,404,881 A * 9/1983 Hanifl ..... 83/167
4,951,540 A * 8/1990 Cross et al. ..... 83/397
4,957,025 A * 9/1990 Beno ..... 83/607
5,001,833 A * 3/1991 Haage ..... 83/610
5,038,477 A * 8/1991 Parrow ..... 30/253

(Continued)

*Primary Examiner*—Laura M. Lee
(74) *Attorney, Agent, or Firm*—Morland C. Fischer

(57) ABSTRACT

A manually operated portable die cutting machine having a rotatable handle arm for generating a pressure necessary to cut a sheet material that is carried by a die cutting assembly and positioned between a movable upper press plate and a stationary lower press plate. A pull-out drawer is slidable outwardly from the body of the die cutting machine to enable access to a storage compartment thereof in which a variety of small articles can be transported. The rotation of a locking knob causes a corresponding rotation of a swing hook into engagement with the handle arm to prevent a rotation of the handle arm when it is desirable to carry the die cutting machine at the side of a user or to prevent use of the machine by a small child. The handle arm includes a handle having an upturned kick which prevents the user's fingers from being pinched when the handle is grasped to rotate the handle arm. The rotatable handle arm is coupled to a camming mechanism through a slot in a press plate top cover that is seated upon and movable with the upper press plate. A protective belt is located in and slidable around the slot to prevent the user from accidentally inserting his fingers through the slot at the same time that the handle arm is being rotated.

16 Claims, 5 Drawing Sheets

U.S. PATENT DOCUMENTS 5,247,863 A * 9/1993 Cohen ..... 83/167
5,255,587 A 10/1993 Eichenberg et al.
6,619,195 B2 9/2003 Corcoran et al.
2005/0087053 A1 * 4/2005 Yu ..... 83/607

* cited by examiner

MANUALLY OPERATED PORTABLE DIE CUTTING MACHINE

BACKGROUND OF THE INVENTION

1. Field of the Invention

This invention relates to a manually operated portable die cutting machine that is capable of generating a sufficient force to cut a sheet material that is carried by a die cutting assembly and located between movable upper and stationary lower press plates of the machine.

2. Background Art

Die cutting machine have been regularly used by schools, libraries, and similar institutions when it is desirable to cut various letters, shapes, and the like from sheet material (e.g., paper, plastic, etc.) for the purpose of making a banner or a display to attract the attention of passersby. A user manipulates a handle or a similar pushing surface of the machine to cause a cutting force to be generated. The cutting force is transferred to a die cutting assembly which carries the sheet material to be cut. In the case of a steel rule cutting die, for example, the sheet material will be cut into the shape or design represented by the steel cutting blades of the cutting die.

However, several problems persist with the operation of a conventional die cutting machine. One significant problem occurs when the user's fingers are subjected to pinching during use of the machine. In the case where the die cutting machine includes a lever arm which rotates relative to a cutting surface, the user sometimes finds his fingers trapped between a handle at one end of the lever arm and the cutting surface. In this case, and provided that the user applies a strong pushing force to rotate the lever arm, his fingers could be injured when the lever arm strikes the cutting surface. The user may also find his fingers caught at the opposite end of the lever arm where such arm interacts with the cutting force generating means of the machine.

What is more, it would be desirable to be able to reliably retain the lever arm in place against the cutting surface to prevent an unauthorized use of the die cutting machine at those times when the machine is not in use. That is, small children who come upon the die cutting machine outside the presence of an adult might attempt to rotate the lever arm during play. Such rotation of the lever arm could result in injury to the child. In this same regard, it would also be desirable to have a reliable and easy-to-use means to retain the lever arm against the cutting surface to permit the die cutting machine to be more easily transported close to the body of the user with a single hand.

Occasionally, it is desirable to have readily available articles (e.g., keys, small hand tools, markers, and the like) that might be needed for use with the die cutting machine or the sheet material to be cut thereby. However, there is currently no means known by which to enable such articles to be stored within the machine to facilitate their transport and prevent the articles from being left behind.

SUMMARY OF THE INVENTION

A manually operated portable die cutting machine is disclosed which is capable of generating a cutting force against a cutting die assembly to cut sheet material and which overcomes the problems listed above. The die cutting machine includes a flat bottom and a generally hollow press body rising upwardly therefrom. A slidable drawer can be pulled outwardly from the hollow press body to provide a compartment within which a variety of small articles may be stored for transport with the machine. The press body surrounds a horizontal deck surface upon which the cutting die assembly and the sheet material to be cut are laid. The cutting die assembly slides over the deck surface towards a movable press plate top cover. The cutting die assembly is moved into a cutting mouth between an upper press plate attached to the bottom of and movable with the press plate top cover and a stationary lower press plate that is located at the end of the deck surface.

A first end of a rotatable handle arm is connected to a camming mechanism through a handle slot that is formed in a finger guard atop the press plate top cover. The handle slot is covered by a protective belt that rides along a track in the finger guard as the handle arm is rotated, whereby to prevent the user from accidentally inserting his fingers through the handle slot. The first end of the handle arm is connected to the camming mechanism such that a rotation of the handle arm is converted into linear (i.e., up and down) movements of the press plate top cover and the upper press plate thereof relative to the lower press plate. An ergonomic handle having an upturned kick that curves upwardly and away from the horizontal deck surface enables a user to apply sufficient palm pressure against the handle to cause the handle arm to rotate towards the deck surface for generating the cutting force necessary for the cutting die assembly located between the upper and lower press plates to cut the sheet material. In this same regard, by virtue of the upturned kick, the user will be less likely to have his fingers pinched between the handle and the deck surface when the handle arm is rotated towards the deck surface.

A swing hook is rotatable out of the deck surface and into mating engagement with a hook latch that is accessible at the underside of the handle arm so as to hold the handle arm against the deck surface. With the handle arm retained against the deck surface, the user can use a single hand to grasp the handle and conveniently transport the die cutting machine along his side and close to his body. A rotatable locking knob at one side of the press body of the machine is connected to the swing hook by means of a shaft, such that a rotation of the locking knob causes a corresponding rotation of the swing hook relative to the hook latch of the handle arm. To prevent the unauthorized use of the die cutting machine by a small child, the rotatable locking knob includes outer and inner knob members which must first be pushed together before the locking knob can be rotated to cause a corresponding rotation of the shaft and the swing hook out of engagement with the hook latch in order to permit the handle arm to rotate away from the deck surface. A spring biased hook retaining finger engages a tab that projects from a mounting collar which surrounds the shaft to prevent a rotation of the shaft and an unintentional disengagement of the swing hook from the hook latch of the handle arm. A lock status indicator is rotatable with the shaft so as to provide a visual indication through a window in the deck surface whether the swing hook is in a latched or unlatched position relative to the hook latch of the handle arm.

DESCRIPTION OF THE PREFERRED EMBODIMENT

Figure 1:
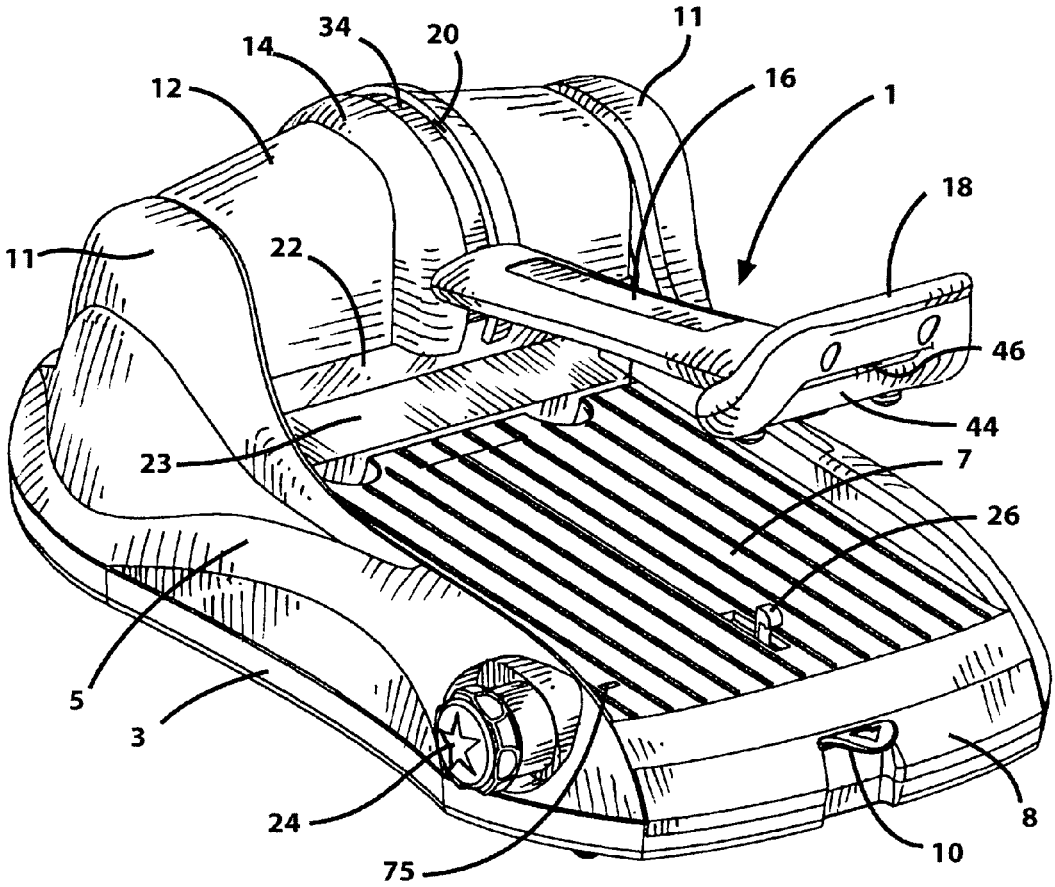
FIG. 1 shows the manually operated portable die cutting machine which forms a preferred embodiment of this invention having a rotatable handle arm extending outwardly over a horizontal deck surface.

The manually operated portable die cutting machine 1 which forms a preferred embodiment of the present invention is described while initially referring to FIG. 1 of the drawings. The die cutting machine 1 includes a flat base 3 to lie on a working surface, such as a table. A generally hollow press body 5 lies above the base 3. The press body 5 of machine 1 surrounds a horizontal deck surface 7 over which a suitable die assembly and sheet material (not shown) to be cut can slide towards an upper press plate 22 at which a compressive cutting force is generated. Accessible at the front of the press body 5 and lying below the deck surface 7 is a pull-out drawer 8, the details of which will be described when referring hereinafter to FIG. 2. The pull-out drawer 8 has an associated pull tab 10 projecting therefrom at which to receive a pulling force by which to cause drawer 8 to move along the base 3 and outwardly from the press body 5.

Located at the rear of the press body 5 of die cutting machine 1 opposite the pull-out drawer 10 and extending between a pair of upstanding lobes 11 is a movable press plate top cover 12. The movement of press plate top cover 12 is controlled by a soon to be described handle arm 16. The top cover 12 includes a finger guard 14 which runs around and bulges outwardly from the top cover 12. The advantage of the finger guard 14 will be described in greater detail when referring to FIGS. 3 and 4.

Connected to the bottom of the press plate top cover 12 and movable therewith is an upper press plate 22. The upper press plate 22 is spaced above a stationary lower press plate that is seated within the press body 5 behind the deck surface 7. The upper press plate 22 is moved downwardly with press plate top cover 12 towards the lower press plate 23 during the manipulation of the handle arm 16 so as to generate a compressive force to be applied to the cutting die assembly that slides along the deck surface 7 for receipt within a die cutting mouth 15 between the upper and lower press plates 22 and 23.

Projecting outwardly from the press plate top cover 12 is the handle arm 16. A handle 18 is affixed to one end of the handle arm 16. As will be more fully described when referring to FIG. 5, the handle 18 has an ergonomic shape which is particularly adapted to avoid injury to the user's fingers when the portable die cutting machine 1 is being used or transported. The opposite end of the handle arm 16 is received through an arcuate handle slot 20 that is formed through the finger guard 14 that runs around the press plate top cover 12.

A rotational force applied to the handle 18 causes a corresponding rotation of the handle arm 16 relative to the horizontal deck surface 7 through an arc of approximately 120 degrees that is defined by the handle slot 20 through the finger guard 14 of press plate top cover 12. The handle arm 16 functions as a lever, such that the rotational movement thereof is imparted to the press plate top cover 12 in the manner shown in FIG. 4 so as to cause the top cover 12 and the upper press plate 22 connected thereto to move in linear (i.e., up and down) directions towards and away from the lower press plate 23 that is situated below the upper press plate 22 and behind the deck surface 7. That is to say, when the handle arm 16 is rotated in a direction towards the deck surface 7, the press plate top cover 12 and the upper press plate 22 are moved together as a unit downwardly to apply a compressive force against the cutting die assembly and sheet material that are disposed in the die cutting mouth 15 between the upper and lower press plates 22 and 23. When the handle arm 16 is rotated in an opposite direction away from the deck surface 7, the press plate top cover 12 and the upper press plate 22 are moved together as a unit upwardly to discontinue the compressive force applied to the cutting die assembly and sheet material, whereby the die assembly and sheet material can now be removed from the cutting mouth 15 to slide out of the cutting machine 1 along the deck surface 7.

Located at one side of the press body 5 of die cutting machine 1 is a rotatable locking knob 24. As will be described in greater detail hereinafter when referring to FIG. 6, the locking knob 24 controls the position of a swing hook 26 that projects upwardly through an opening formed in the deck surface 7. A rotational force applied to the locking knob 24 causes the swing hook 26 to rotate into engagement with the handle arm 16 by which to lock the handle arm 16 and the handle 18 against the horizontal deck surface 7 so as to facilitate the transport of the portable die cutting machine 1 along the side of the user in a manner that will soon be described.

Figure 2:
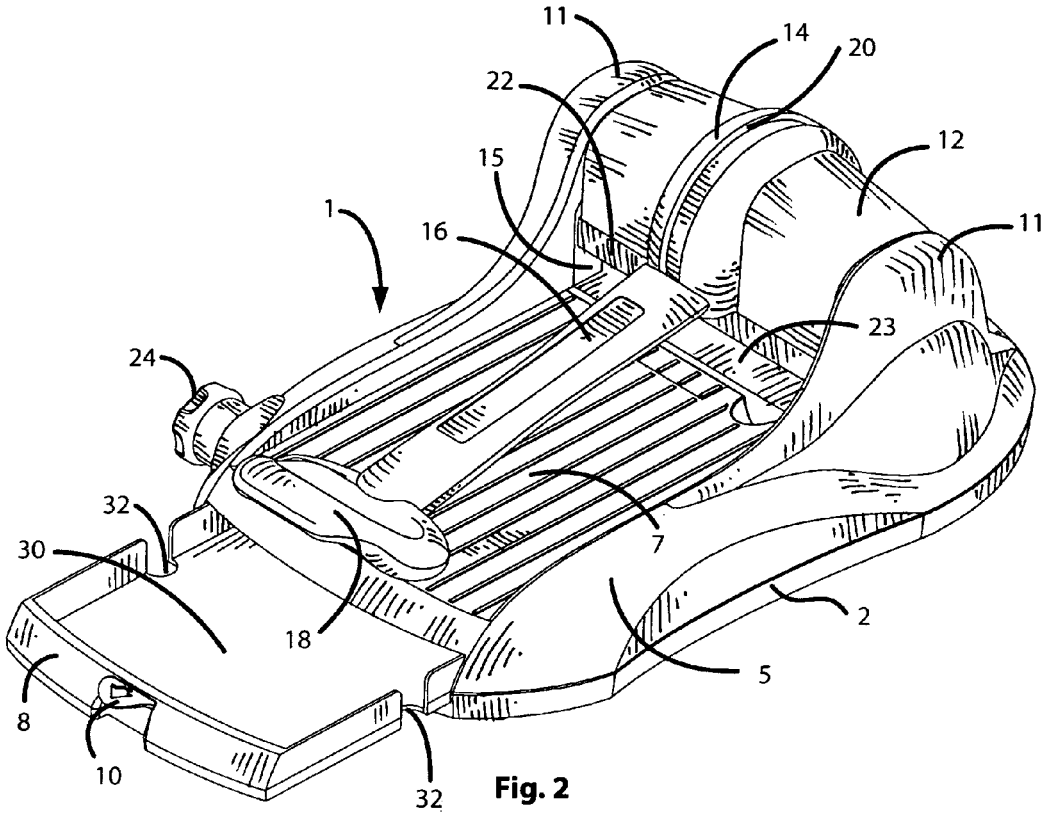
FIG. 2 shows a drawer pulled outwardly from a hollow press body of the die cutting machine of FIG. 1 so as to gain access to a storage compartment of the drawer.

Turning now to FIG. 2 of the drawings, the portable die cutting machine 1 of FIG. 1 is shown with the pull-out drawer 8 thereof pulled outwardly from the front of the hollow press body 5. That is, a pulling force applied to the pull tab 10 will cause drawer 8 to slide outwardly and thereby enable the user to gain access to a storage compartment 30 at the interior thereof. Thus, a variety of items may be conveniently placed in the storage compartment 30 to be carried by the die cutting machine 1 once the drawer 8 is pushed inwardly and returned to the press body 5. A pair of finger lifting slots 32 at opposite sides of the pull-out drawer 8 enables the user to more easily grasp the items to be removed from the storage compartment 30.

Figure 3:
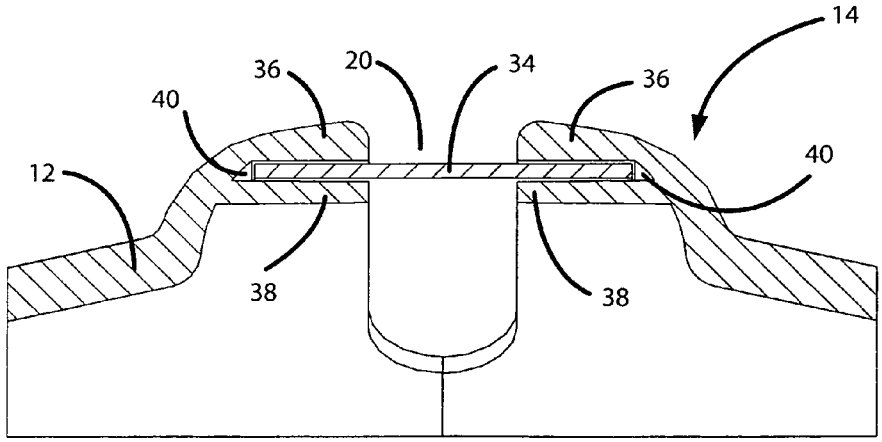
FIG. 3 shows an enlarged detail of a protective belt located in a track formed in a finger guard atop a press plate top cover of the die cutting machine.
Figure 4:
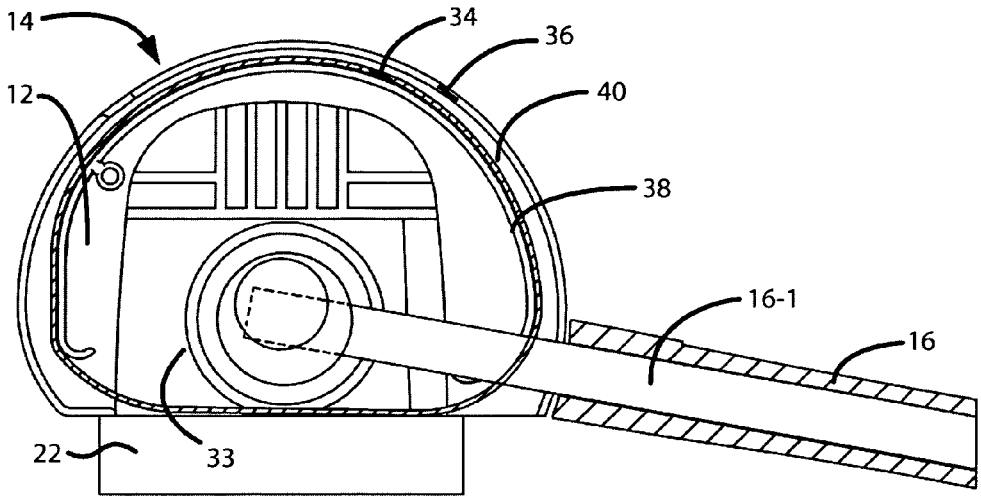
FIG. 4 shows the handle arm coupled to a camming mechanism inside the press plate top cover such that a rotation of the handle arm is translated into the linear movement of the press plate top cover.

FIGS. 3 and 4 of the drawings show an enlarged detail of the finger guard 14 which runs around and bulges outwardly from the press plate top cover 12 of the die cutting machine 1 of FIG. 1. As previously disclosed, the handle arm 16 is received through a handle slot 20 that is formed in the finger guard 14, such that a rotation of the handle arm 16 causes a corresponding linear displacement of the press plate top cover 12 and the upper press plate 22 connected at the bottom thereof. To this end, a cam rod 16-1 (best shown in FIG. 4) of the handle arm 16 is connected at the interior of the press plate top cover 12 to a camming mechanism (designated 33 in FIG. 4) which is capable of converting a rotational movement (of arm 16) into a linear movement (of top cover 12). Inasmuch as such camming mechanisms are known, the camming mechanism 33 shown herein will not be described in detail.

In order to prevent a user from accidentally inserting his fingers into the handle slot 20 through which the handle arm 16 and cam rod 16-1 is received, a protective belt 34 is located within the slot 20. The protective belt 34 is preferably manufactured from a flexible material such as, for example, a high density polyethylene or a nylon. As is best shown in FIG. 4, the cam rod 16-1 of handle arm 16 extends through a hole formed in the protective belt 34 to be connected to and manipulate the camming mechanism 33 surrounded by the press plate top cover 12. The cam rod 16-1 is thusly connected to the protective belt 34 so that a rotation of the handle arm 16 through the arc defined by the arcuate handle slot 20 in finger guard 14 exerts a pulling force on and causes a corresponding rotation of the protective belt 34 around the finger guard.

The finger guard 14 includes pairs of spaced, parallel aligned walls 36 and 38 that establish a track 40 therebetween. The track 40 is sized to accommodate the protective belt 34 and permit belt 34 to ride therealong in response to a rotational movement of the handle arm 16 for generating a pulling force and thereby causing a corresponding rotation of belt 34. Hence, the protective belt 34 will at all times cover the handle slot 20 and prevent the user from inserting his finger therethrough regardless of the rotational position of the handle arm 16 relative to the slot 20. By virtue of the foregoing, a user will be less likely to suffer a pinched finger as might otherwise occur had the handle slot 20 been unguarded. What is more, and by virtue of the bulging nature of the finger guard 14 above the press plate top cover 12, the user will be unable to accidentally reach between the upper press plate 22 and the cam rod 16-1 to avoid pinching his fingers.

Figure 5:
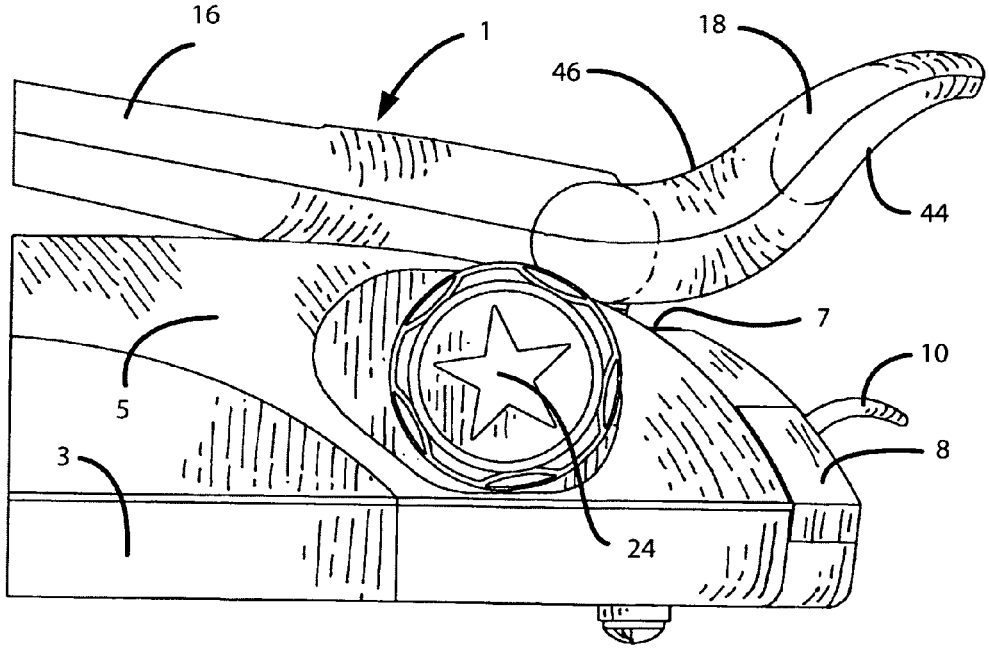
FIG. 5 shows a handle having a upturned kick located at one end of the handle arm to receive a palm pressure of a user thereagainst.

Details of the ergonomic features of the handle 18 located at one end of the handle arm 16 are now disclosed while referring to FIG. 5 of the drawings. The handle 18 includes a curved kick 44 that turns upwardly and away from the deck surface 7 of the die cutting machine 1. The upwardly turned kick 44 of handle 18 provides several advantages.

By way of a first advantage, the curved nature of the upturned kick 44 will establish a rest to accommodate the palm of the user thereagainst for applying a palm pressure. Thus, the user will be able to more efficiently generate a pushing force to be applied to handle 18 for causing the handle arm 16 to rotate in a direction towards the deck surface 7 when it is desirable to cut a sheet material that is carried by a cutting die assembly and moved to the cutting mouth 15 (of FIGS. 1 and 2) between the upper and lower press plates 22 and 23.

Figure 6:
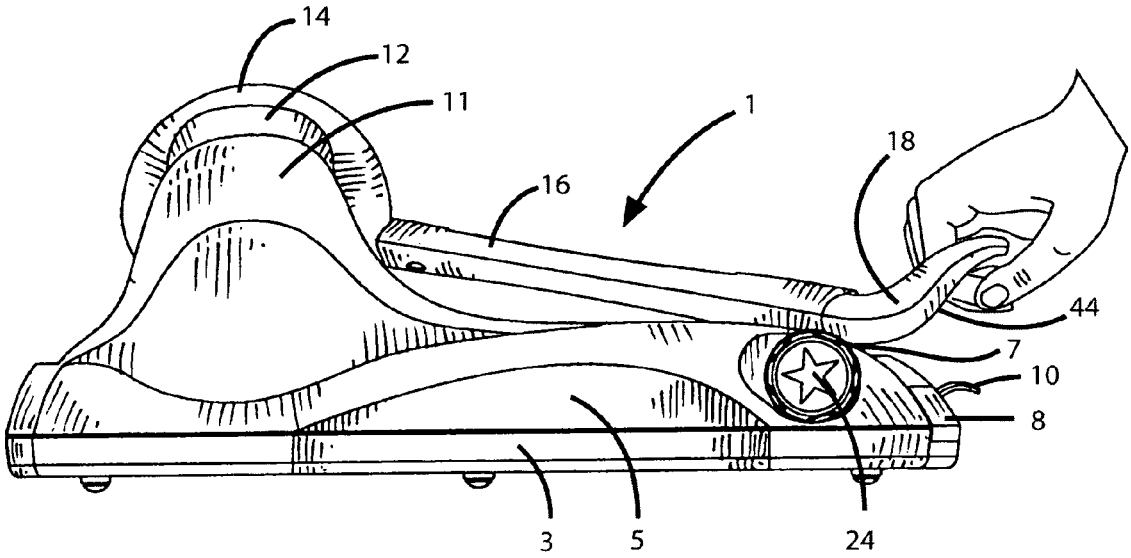
FIG. 6 shows the handle arm locked against the deck surface so that the handle can be grasped with a single hand to permit the die cutting machine to be conveniently transported along a side of the user.

By way of another advantage, the handle 18 has a cut-out area 46 that is sized to receive the fingers of the user. When it is desirable to transport the portable die cutting machine 1, and as is best shown in FIG. 6 of the drawings, the handle arm 16 is rotated in a first downward direction completely through its 120 degree arc until the handle 18 contacts the horizontal deck surface 7. With the soon to be described swing hook (designated 26 in FIGS. 1, 7, 8 and 9) rotated into engagement with the handle arm 16, the handle arm 16 will be locked in place so as to be unable to rotate in an opposite upward direction away from the deck surface 7. The die cutting machine 1 may now be conveniently carried by a single hand so as to hang downwardly along a side of the user after the user inserts his fingers through the cut-out area 46 in order to grasp the handle 18. In this case, the majority of the weight of the hanging machine 1 being transported will rest near the bottom (i.e., at the press plate top cover 12). Moreover, by virtue of the upturned kick 44 of handle 18, the user's fingers are held away from the press body 5 of machine 1 so as to be less likely to be squeezed or pinched against the deck surface 7 which lies below the handle 18. In this same regard, it will no longer be necessary to locate cushions on the deck surface 7, as is often required in some die cutting machines, to avoid injury to the user's fingers when the handle arm thereof is rotated to generate a cutting force.

Figure 7:
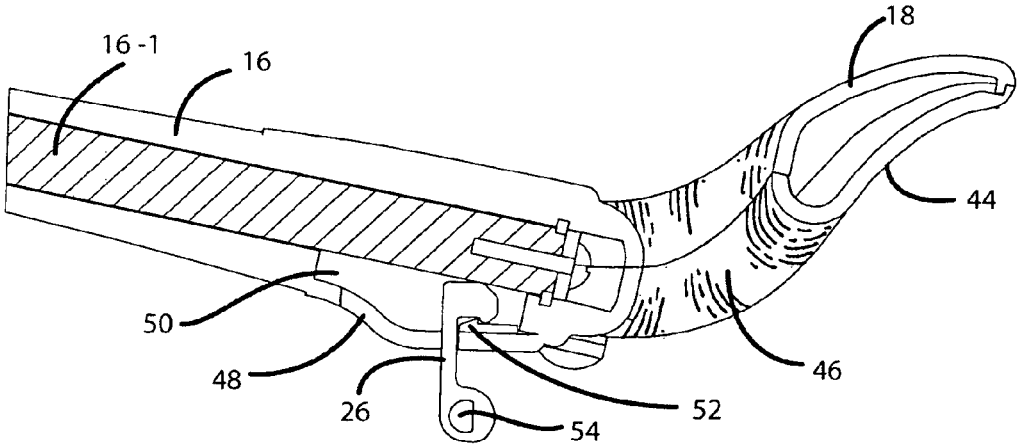
FIG. 7 shows an enlarged detail of a swing hook rotated into mating engagement with a hook latch at the underside of the handle arm by which to lock the handle arm against the deck surface of the machine.

Referring to FIG. 7 of the drawings, the swing hook 26 is shown rotated into engagement with the handle arm 16 in order to lock the handle arm 16 against the deck surface 7 (of FIG. 6) when it is desirable to either prevent the unauthorized use of the die cutting machine or to transport die cutting machine 1 at the side of the user with the user's fingers moved through the finger grip cut-out area 46 of handle 18. To accomplish the foregoing, an open window 48 is formed in the bottom of handle arm 16 to communicate with a latching chamber 50. A hook latch 52 is located inside latching chamber 50 at the underside of arm 16 so as to be aligned for mating engagement with swing hook 26.

Figure 8:
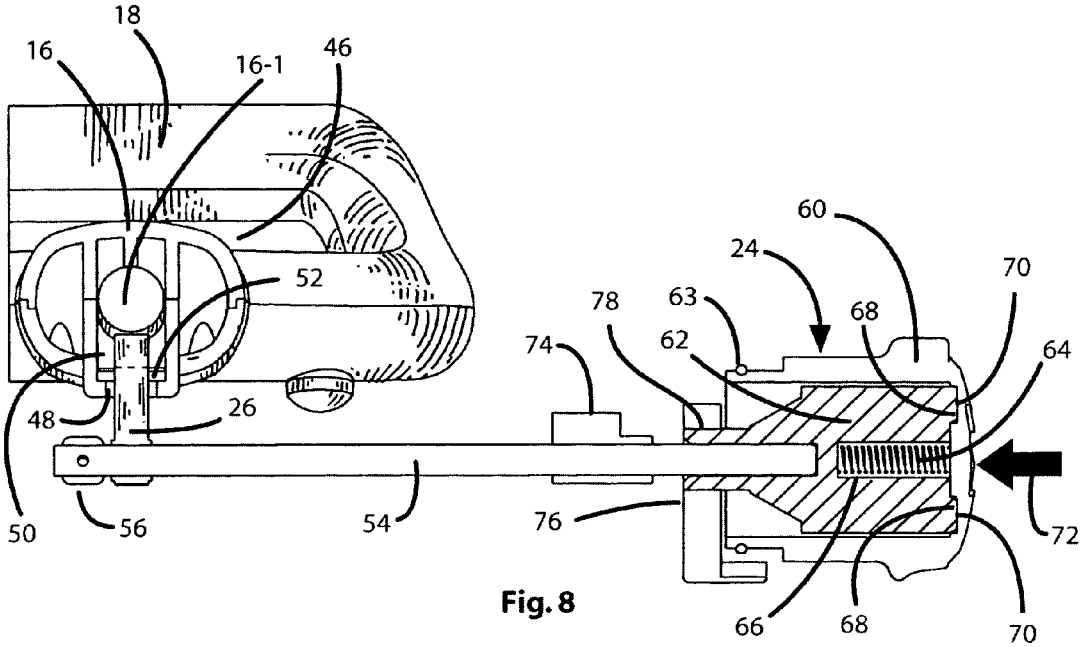
FIG. 8 shows a rotatable locking knob connected by a shaft to the rotatable swing hook by which to rotate the swing hook between latched and unlatched positions relative to the hook latch of the handle arm.
Figure 9:
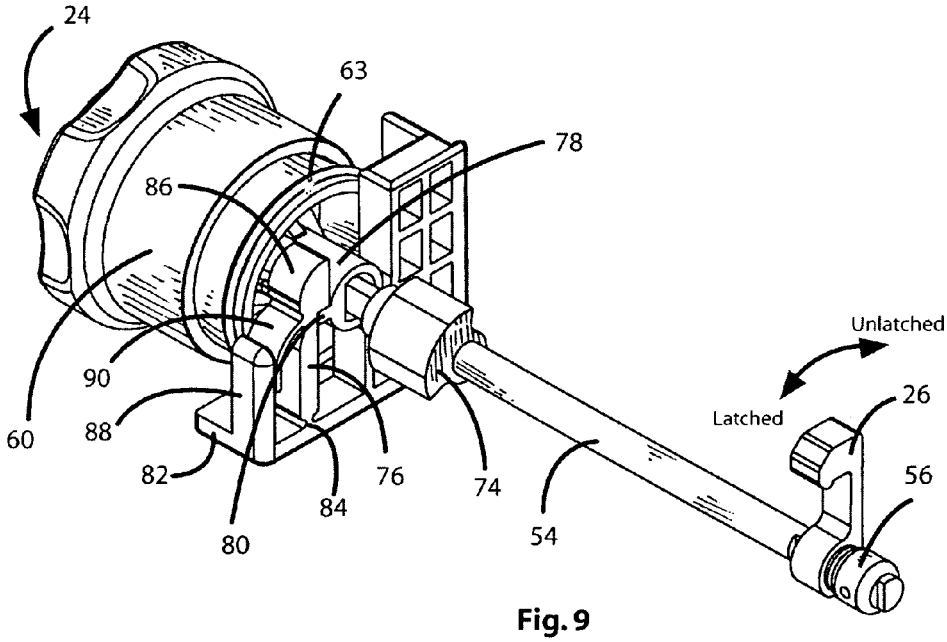
FIG. 9 shows a swing hook retaining finger engaging a tab of a mounting collar on the shaft of FIG. 8 to prevent an unintended disengagement of the swing hook from the hook latch of the handle arm.

As was previously disclosed when referring to FIG. 1, and as will be more fully disclosed when referring to FIG. 8, the swing hook 26 is rotated relative to the deck surface 7 of machine 1 in response to a rotation of a rotatable locking knob (designated 24 in FIGS. 1, 8 and 9). The rotatable locking knob 24 is connected to swing hook 26 by way of a shaft 54. Therefore, a rotational force applied to locking knob 24 in a first direction will be imparted to swing hook 26 via shaft 54 to cause the swing hook 26 to rotate out of the deck surface 7 and into the latching chamber 50 via window 48. The swing hook 26 will continue to rotate until it is captured by the hook latch 52 within chamber 50. The swing hook 26 will remain in mating engagement with hook latch 52 until an opposite rotational force is applied to the locking knob 24 to cause swing hook 26 to be rotated out of the latching chamber 50 and retracted inwardly of the deck surface 7.

FIG. 8 of the drawings shows details for the interconnection of the rotatable locking knob 24 to the swing hook 26 by means of shaft 54 so that the swing hook 26 can be rotated through the window 48 at the bottom of handle arm 16 and into mating engagement with the hook latch 52 within latching chamber 50 in order to lock the handle arm 16 against the deck surface 7 (as is best shown in FIG. 6). The swing hook 26 can be attached around the shaft 54 at a recess formed therein (not shown) so that the rotatable locking knob 24, the shaft 54, and the swing hook 26 will rotate together as a unit. A lock washer 56 is connected to the end of the shaft 54 which lies opposite locking knob 24 to prevent an inadvertent lateral displacement of the swing hook 26 off shaft 54.

The rotatable locking knob 24 includes outer and inner knob members 60 and 62. The outer knob member 60 surrounds the inner knob member 62, and the inner knob member 62 is affixed to one end of the shaft 54 so as to lie opposite the swing hook 26 and the lock washer 56. A circular compression clip 63 surrounds the outer knob member 60, so as to prevent the outer knob member 60 from being pulled off the inner knob member 62 and separated from the press body 5. In the at-rest condition of the rotatable locking knob 24 (not shown), a coil spring 64 that lies in an axial spring cavity 66 through the inner knob member 62 pushes the head of the outer knob member 60 approximately 0.5 cm away from the head of the inner knob member 62. In this case, the outer knob member 60 will be spaced axially from and rotate freely around the inner knob member 62 should a small child attempt to rotate the locking knob 24. In other words, in the at-rest condition of rotatable locking knob 24, the heads of the outer and inner knob members 60 and 62 are separated from one another so as to prevent the transfer of a rotational force from the locking knob 24 and to swing hook 26 by way of the shaft 54. Accordingly, the swing hook 26 cannot be rotated out of its locking engagement with the hook latch 52 of handle arm 16 whereby to prevent an unauthorized use of the die cutting machine 1 by young children.

A series of raised teeth 68 project outwardly from and around the periphery of the head of the inner knob member 62 of locking knob 24. A matched series of inwardly facing grooves 70 are formed in and extend around the periphery of the head of the outer knob member 60 in opposite facing alignment with the teeth 68 of inner member 62. In order to rotate the swing hook 26 out of its locking engagement with the hook latch 52 so as to be able to rotate the handle arm 16 away from the deck surface 7 and thereby use the die cutting machine 1, the user first applies an axial pushing force in the direction of the reference arrow 72 against the head of the outer knob member 60. The head of the outer knob member 60 will then move towards the head of the inner knob member 62, the spring 64 within spring cavity 66 will be compressed, and the teeth 68 which project outwardly from the inner knob member 62 will be received in respective ones of the inwardly facing grooves 70 formed in outer knob member 60 in the manner shown in FIG. 8.

Therefore, a rotational force applied to the rotatable locking knob 24 at the outer knob member 60 will now be transmitted to the inner knob member 62 at the interface of the teeth 68 with the grooves 70. The inner knob member 62 will rotate with the outer knob member 60, and such rotation will be imparted to the shaft 54 and then to the swing hook 26. Thus, a rotation of the locking knob 24 will cause a corresponding rotation of the swing hook 26 out of its locking engagement with the hook latch 52 of handle arm 16. Of course, a rotation of the locking knob 24 in an opposite direction will cause the swing hook 26 to rotate back into locking engagement with hook latch 52. When the axial pushing force 72 is removed from the head of the outer knob member 60, the spring 64 will be allowed to expand so as to cause the outer knob member 60 to be pushed away from the inner knob member 62 so that the rotatable locking knob 24 will automatically return to its at-rest position.

A lock status indicator 74 is affixed to and rotatable with the shaft 54 which connects the rotatable locking knob 24 to the swing hook 26. The lock status indicator 74 is provided with different colors (e.g., red and green) or different printed indicia (e.g., LOCKED and UNLOCKED) to provide a visual indication to the user at a window (designated 75 in FIG. 1) formed in the deck surface 7 as to whether the swing hook 26 is rotated into a latched position or an unlatched position relative to the hook latch 52 in the latching chamber 50 of handle arm 16. That is, when the swing hook 26 is rotated into mating engagement with hook latch 52, the lock status indicator 74 is correspondingly rotated with the shaft 54 so as to display at window 75 the color red, the word LOCKED, or any other suitable message to indicate that the handle arm 16 is locked in place against the deck surface 7. When the swing hook 26 is rotated out of engagement with hook latch 52, the lock status indicator 74 will display at window 75 the color green, the word UNLOCKED, or a suitable message to indicate that the handle arm 16 is now disengaged from the deck surface 7 to enable use of the die cutting machine 1.

Referring concurrently to FIGS. 8 and 9 of the drawings, a swing hook retaining finger 76 is shown by which to prevent the swing hook 26 from accidentally sliding out of engagement with the hook latch 52 at the underside of the handle arm 16 at those times when it is desirable to prevent the handle arm 16 from being rotated away from the deck surface 7 (of FIGS. 5 and 6). More particularly, a hollow cylindrical mounting collar 78 is integrally formed with and axially extended from the inner knob member 62 of the rotatable locking knob 24 so as to project inwardly of the hollow press body 5 of the die cutting machine 1 (also of FIGS. 5 and 6). The mounting collar 78 of inner knob member 62 is located in surrounding engagement with the shaft 54 such that a rotation of the locking knob 24 (after the outer knob member 60 has been pushed into contact with the inner knob member 62 in the manner earlier described while referring to FIG. 8) causes a rotation of shaft 54 as well as the swing hook 26 and the lock status indicator 74 coupled thereto. A hook retaining tab 80 is carried by and projects outwardly from the mounting collar 78 so that mounting collar 78 and hook retaining tab 80 will rotate in unison with the locking knob 24, shaft 54, swing hook 26 and indicator 74.

The swing hook retaining finger 76 is preferably manufactured from a flexible plastic material. One end of retaining finger 76 is pivotally connected to a flat finger support 82 by means of a (e.g., living) hinge 84. A relatively large catch 86 is located at the opposite end of retaining finger 76. By virtue of its flexible nature and its pivotal connection to finger support 82, the retaining finger 76 is adapted to rotate at hinge 84 in response to a rotation of the mounting collar 78 and tab 80 thereof.

The finger support 82 to which the swing hook retaining finger 76 is pivotally attached is located in a cavity (not shown) that is formed within the hollow press body 5 above the base 3 of machine 1. An upstanding post 88 is fixedly connected to finger support 82 so as to be held in spaced parallel alignment with retaining finger 76. Depending outwardly from the retaining finger 76 so as to lie against the upstanding post 88 is a flexible spring member 90. By virtue of its contact with the post 88, the spring member 90 is normally biased so as to exert a pushing force on the retaining finger 76 and thereby urge the relatively wide catch 86 thereof towards the mounting collar 78 in order to capture the hook retaining tab 80 projecting therefrom. With retaining tab 80 captured by the catch 86 of retaining finger 76, the mounting collar 78 will be unable to rotate.

At the same time, and with mounting collar 78 held in place by the engagement of retaining tab 80 by the catch 86 of retaining finger 76, the shaft 54 which carries the swing hook 26 will remain stationary. Thus, it is unlikely that the swing hook 26 will inadvertently move out of engagement with the hook latch 52 of the handle arm 16 when it is otherwise intended that the swing hook 26 remain engaged to hook latch 52 to prevent a rotation of handle arm 16 away from the deck surface 7 of machine 1.

However, and continuing to refer to FIGS. 8 and 9, when it is desirable to rotate the handle arm 16, the locking knob 24 is first rotated which correspondingly rotates the shaft 54 and the swing hook 26 in the manner earlier disclosed, whereby swing hook 26 moves from the latched position to the unlatched position (illustrated in FIG. 9) relative to the hook latch 52 of handle arm 16. The rotation of the locking knob 24 is imparted to the mounting collar 78 so that when the swing hook 26 is being rotated to the unlatched position, the rotation of the retaining tab 80 relative to the catch 86 of swing hook retaining finger 76 will overcome the force generated by the spring member 90 and thereby enable the tab 80 to move out of its engagement with the hook retaining tab 80 of mounting collar 78. Accordingly, the retaining finger 76 will receive a pushing force and rotate at its hinge 84 towards the upstanding post 88, whereupon the spring member 90 which depends from finger 76 will be deflected against post 88 and store energy. Once the hook retaining tab 80 of mounting collar 78 moves past the catch 86, the spring member 80 will expand to release its stored energy and thereby force the retaining finger 76 to automatically rotate away from the post 88 and back to its position as shown in FIG. 9 until the locking knob 24 is once again rotated to return the swing hook 26 to the latched position at which to lie in mating engagement with the hook latch 52 of handle arm 16.

Rotation of the shaft 54 and the swing hook 26 carried thereby is controlled, in the preferred embodiment, by a rotatable locking knob 24. However, the locking knob 24 could be replaced by a rotatable key lock that is coupled to the shaft 54. In this case, a key is required to be able to rotate the lock, the shaft coupled thereto, and the swing hook carried by the shaft.

We claim:

1. A die cutting machine to generate a cutting force to be applied to a cutting die for cutting a material, said die cutting machine comprising a body, a deck surface supported by said body upon which the cutting die is laid, a press plate that is movable in a direction towards said deck surface to apply the cutting force against the cutting die, a press plate cover located above and movable with said press plate, a rotatable lever arm extending through said press plate cover such that a rotation of said lever arm relative to said deck surface causes a corresponding linear movement of said press plate cover and said press plate, a swing hook that is rotatable from an unlatched position at which to release said lever arm to a latched position at which to engage said lever arm and hold said lever arm against said deck surface, a rotatable locking knob that is connected to said swing hook such that a rotation of said locking knob causes a corresponding rotation of said swing hook between the unlatched and latched positions, a shaft extending between said rotatable locking knob and said swing hook such that a rotation of said locking knob causes a rotation of said shaft and a corresponding rotation of said swing hook between the unlatched and latched positions, a mounting collar extending from said locking knob and surrounding said shaft so as to cause said shaft to rotate in response to a rotation of said locking knob, a tab projecting from said mounting collar, and a swing hook retainer for engaging the tab of said mounting collar to prevent a rotation of said shaft and a corresponding rotation of said swing hook from the latched position to the unlatched position.

2. The die cutting machine recited in claim 1, wherein said swing hook retainer is adapted to rotate into and out of engagement with the tab projecting from said mounting collar, said swing hook retainer being rotated out of engagement with said tab for permitting a rotation of said shaft and a corresponding rotation of said swing hook from the latched position to the unlatched position.

3. The die cutting machine recited in claim 2, further comprising a pivot located at one end of said swing hook retainer by which to permit the rotation of said swing hook retainer relative to the tab of said mounting collar and a catch located at the opposite end by which to capture the tab of said mounting collar when said swing hook retainer is rotated into engagement therewith.

4. The die cutting machine recited in claim 3, further comprising a spring depending from said swing hook retainer to exert a pushing force thereagainst for urging the catch of said spring hook retainer into engagement with the tab of said mounting collar.

5. The die cutting machine recited in claim 1, further comprising a pull-out drawer slidable outwardly from said body, said pull-out drawer having a storage compartment within which articles can be stored and transported with said machine.

6. The die cutting machine recited in claim 5, wherein said pull-out drawer has at least one finger slot formed therein for receipt of a user's finger by which to lift the articles out of said storage compartment.

7. The die cutting machine recited in claim 1, further comprising a handle located at one end of said rotatable lever arm, said handle having a gripping surface that is spaced from said deck surface when said lever arm is engaged by said swing hook and held against said deck surface.

8. The die cutting machine recited in claim 7, wherein said handle has a finger slot formed therein for receipt of the user's fingers by which to enable the user to grasp said handle and transport said machine with a single hand after said rotatable lever arm is first rotated towards and held against said deck surface by said swing hook.

9. The die cutting machine recited in claim 1, wherein said rotatable lever arm extends through a lever arm slot formed in said press plate cover, said machine further comprising a protective belt to cover said lever arm slot and thereby prevent the fingers of a user from being inserted therethrough.

10. The die cutting machine recited in claim 9, wherein said press plate cover includes a track for receipt of said protective belt, said lever arm extending through said lever arm slot formed in said press plate cover to engage said protective belt, such that a rotation of said lever arm causes said protective belt to ride along said track.

11. The die cutting machine recited in claim 1, wherein said lever arm includes a hook latch, said swing hook being rotated to the latched position and into mating engagement with said hook latch so as to hold said lever arm against said deck surface.

12. The die cutting machine recited in claim 1, wherein said rotatable locking knob includes an outer knob member and inner knob member, said inner knob member coupled to said swing hook and said outer knob member surrounding said inner knob member and spaced therefrom, said outer knob member being moved against said inner knob member in response to a first pushing force so that a rotation of said outer knob member is transferred to said swing hook by way of said inner knob member.

13. The die cutting machine recited in claim 12, further comprising a spring carried by said inner knob member and positioned to engage said outer knob member for exerting a second pushing force on said outer knob member by which said outer knob member is spaced from said inner knob member, said first pushing force applied to said outer knob member overcoming the second pushing force exerted by said spring for causing said outer knob member to be moved against said inner knob member.

14. The die cutting machine recited in claim 12, wherein one of said outer and inner knob members has a plurality of teeth projecting therefrom and the other one of said outer and inner knob members has a plurality of oppositely facing grooves formed therein, said plurality of teeth received within respective ones of said plurality of grooves when said outer knob member is moved against said inner knob member such that a rotation of said outer knob member is transferred to said swing hook by way of said inner knob member at the interface of said teeth within said grooves.

15. The die cutting machine recited in claim 1, further comprising an indicator coupled to and rotatable with said shaft to provide a visual indication whether said swing hook is in the unlatched position at which to release said lever arm or the latched position at which to engage said lever arm.

16. The die cutting machine recited in claim 15, further comprising a window formed in said deck surface and aligned with said indicator such that the indication of whether said swing hook is in the unlatched or latched position is visible through said window.

* * * * *